US008720745B2

(12) United States Patent
Bentchev et al.

(10) Patent No.: US 8,720,745 B2
(45) Date of Patent: May 13, 2014

(54) DISPENSING SYSTEM AND SECURITY DEVICE FOR USE IN CONJUNCTION THEREWITH

(75) Inventors: Dimitar B. Bentchev, Norwood, MA (US); John S. Berg, Franklin, MA (US); David A. Waldman, Concord, MA (US)

(73) Assignee: ProTeqt Technologies, Inc., Franklin, MA (US)

( * ) Notice: Subject to any disclaimer, the term of this patent is extended or adjusted under 35 U.S.C. 154(b) by 9 days.

(21) Appl. No.: 13/460,321

(22) Filed: Apr. 30, 2012

(65) Prior Publication Data

US 2012/0273522 A1 Nov. 1, 2012

Related U.S. Application Data

(60) Provisional application No. 61/517,955, filed on Apr. 28, 2011.

(51) Int. Cl.
*B67B 1/00* (2006.01)

(52) U.S. Cl.
USPC ..... 222/153.01; 222/464.1; 222/320

(58) Field of Classification Search
USPC ..... 340/540, 572.3; 222/320, 153.01, 222/153.04, 153.11, 153.12, 153.14, 464.1
See application file for complete search history.

(56) References Cited

U.S. PATENT DOCUMENTS

| | | | | |
|---|---|---|---|---|
| 3,990,611 | A | 11/1976 | Sojka | |
| 4,273,272 | A * | 6/1981 | Blanc | 222/464.4 |
| 5,366,119 | A | 11/1994 | Kline | |
| 5,385,271 | A * | 1/1995 | Bierend et al. | 222/153.14 |
| 5,427,277 | A * | 6/1995 | Bierend et al. | 222/153.09 |
| 5,675,318 | A * | 10/1997 | Hunt, Jr. | 340/540 |
| 5,791,520 | A * | 8/1998 | Tichenor | 222/82 |
| 5,850,943 | A * | 12/1998 | Tichenor et al. | 222/153.11 |
| 5,855,297 | A * | 1/1999 | Tichenor et al. | 222/61 |
| 5,873,474 | A * | 2/1999 | Gray | 215/11.1 |
| 5,934,519 | A * | 8/1999 | Kim et al. | 222/464.4 |
| 6,343,714 | B1 * | 2/2002 | Tichenor | 222/153.11 |
| 2004/0089674 | A1 * | 5/2004 | Harrity et al. | 222/464.4 |
| 2005/0133626 | A1 * | 6/2005 | Hornsby et al. | 239/380 |
| 2008/0110937 | A1 * | 5/2008 | Guill | 222/464.4 |
| 2010/0140303 | A1 * | 6/2010 | Baglin | 222/464.4 |
| 2010/0300159 | A1 | 12/2010 | Berg et al. | |
| 2012/0112912 | A1 * | 5/2012 | Berg | 340/572.3 |

* cited by examiner

*Primary Examiner* — Paul R Durand
*Assistant Examiner* — Randall Gruby
(74) *Attorney, Agent, or Firm* — Kriegsman & Kriegsman

(57) ABSTRACT

A product dispensing system includes a partially-open container for retaining a supply of the product, a mechanism for dispensing a quantity of the product from the container, and a remotely-activated security device for selectively restricting the dispensing of product from the container. In one embodiment, the security device is in the form of a spherical enclosure that is mounted over the inlet port for a draw tube of the dispensing mechanism. In use, the security device includes an activation mixture, such as an expandable adhesive, that transitions the security device between a first state and a second state in response to an application of certain non-mechanical stimuli, such electromagnetic energy of a particular profile, the security device restricting the passage of the product through the draw tube when disposed in the first state and permitting the passage of the product through the draw tube when disposed in the second state.

13 Claims, 11 Drawing Sheets

DISPENSING SYSTEM AND SECURITY DEVICE FOR USE IN CONJUNCTION THEREWITH

CROSS-REFERENCE TO RELATED APPLICATIONS

The present application claims the benefit of U.S. Provisional Patent Application Ser. No. 61/517,955, which was filed on Apr. 28, 2011 in the names of John S. Berg, Dimitar B. Bentchev and David A. Waldman, the disclosure of which is incorporated herein by reference.

FIELD OF THE INVENTION

The present invention relates generally to the retail industry and more particularly to merchandise security devices used in the retail industry.

BACKGROUND OF THE INVENTION

Dispensing systems, also commonly referred to simply as dispensers, are well known and are widely used in the cosmetics industry to hold and dispense a variety of liquid-based or semi-solid cosmetic products, such as, but not limited to, perfumes, lotions, soaps, creams, gels, moisturizers, shampoos and oils.

One type of dispensing system that is commonly used in the cosmetics industry is a pump-type dispenser. Traditionally, a pump-type dispenser includes a container for retaining a supply of the cosmetic product and a pump-type dispensing mechanism coupled to container for enclosing the container and enabling a small quantity of the product to be dispensed out therefrom. The dispensing mechanism typically includes, among other things, an annular collar that is threadingly mounted onto an open end of the container, a hollow stem that is slidably displaceable within the collar and resiliently biased vertically upward relative thereto by a spring, an actuation head mounted onto the externally-located, upper end of the stem, and an elongated dipping, or draw, tube mounted onto the internally-located, lower end of the stem in fluid communication therewith, the draw tube extending vertically down into the supply of the product retained within the interior of the container.

In use, depression of the actuation head results in the downward displacement of the stem which, in turn, opens an internal valve and thereby enables a predefined quantity of the product that has been previously drawn into the dipping tube to be ejected out through an opening formed in the head. Once the downward force applied to the actuation head is withdrawn, the stem is urged vertically upward relative to the collar by the internal spring. As can be appreciated, the upward movement of the stem creates a suction-type, or syphoning, action that draws a metered supply of the product into the draw tube through an inlet, or opening, in its free end. Because the internal valve closes upon release of the actuation head, the drawn supply of the product remains disposed within the dipping tube until the actuation head is depressed once again.

Cosmetic products contained within pump-type dispensers have become subject to increased levels of theft and tampering. In particular, it has been found that cosmetic products displayed for sale in a traditional retail environment are often sampled by unscrupulous consumers without having been purchased. As can be appreciated, the sampling of relatively expensive cosmetic products, such as high-end perfumes and lotions, is of particular concern in the retail industry.

The prevention of merchandise theft and tampering of cosmetic products contained within dispensers has been the subject of numerous technical approaches.

As one protective measure, dispensers containing cosmetic products are commonly provided with externally mounted means for deterring theft and tampering. For instance, a cap is often mounted over the actuation head of a dispenser and is secured to the collar by a removable shrink-wrap, thereby precluding access to the dispensing mechanism. In addition, the dispenser is often packaged within an enlarged outer carton to further limit sampling and minimize the risk of theft. To provide further protection of the product, a security device, such as an electronic article surveillance (EAS) or radio frequency identification (RFID) device, may be secured to the packaging, the security device being adapted to trigger an alarm if the article is moved beyond a predetermined location without having been deactivated or removed from the packaging.

As another protective measure, dispensers containing cosmetic products are often presented for sale in a limited access environment, such a locked display case.

Although useful in preventing theft and tampering, the security measures set forth in detail above have been found to suffer from a number of notable drawbacks.

As a first drawback, it has been found that the use of externally mounted means for deterring theft and tampering, such as a protective cap and/or relatively bulky outer packaging, serves to significantly detract from the aesthetic qualities of certain dispensers. Most notably, dispensers for high-end cosmetics are often designed with a significant stylistic component, the artistic quality of such dispensers being compromised when relatively conspicuous security devices are externally coupled thereto.

As a second drawback, it should be noted that each externally mounted means for deterring theft and tampering set forth in detail above is designed to be easily removed after purchase by the consumer (e.g., by cutting the shrink-wrap and removing the cap or by removing the dispenser from its outer packaging). As a result, these security measures do not ultimately deny access to the cosmetic product if the dispenser has been improperly obtained, such as by theft.

As a third drawback, it has been found that the protective measure of restricting consumer access and direct handling of cosmetic products at the point-of-sale (e.g., by displaying the product in an enclosed case) serves as a significant hindrance to purchase.

BRIEF SUMMARY OF THE INVENTION

It is an object of the present invention to provide a new and improved system for dispensing a product.

It is another object of the present invention to provide a product dispensing system as described above that includes a security device for preventing unauthorized dispensing of the product.

It is yet another object of the present invention to provide a product dispensing system as described above that is not aesthetically compromised by the inclusion of the security device.

It is yet still another object of the present invention to provide a product dispensing system as described above wherein the security device cannot be readily removed by an unauthorized party.

It is another object of the present invention to provide a product dispensing system of the type described above which allows for direct handling by consumers at the point-of-sale.

It is still another object of the present invention to provide a product dispensing system of the type as described above that has a limited number of parts, is inexpensive to manufacture and is easy to use.

Accordingly, as a principal feature of the present invention, there is provided a system for dispensing a product, the system comprising (a) a container shaped to define an interior cavity, the container being adapted to retain a supply of the product within the interior cavity, (b) a dispensing mechanism adapted to dispense a quantity of the supply of the product from the container, the dispensing mechanism including a draw tube with an intake port disposed within the interior cavity, and (c) a security device coupled to the draw tube, the security device being adapted to transition between a first state and a second state in response to an application of non-mechanical stimuli, the security device restricting the passage of the product through the draw tube when disposed in the first state and permitting the passage of the product through the draw tube when disposed in the second state.

As another feature of the present invention, there is provided a security device for a product dispensing system, the product dispensing system comprising a container for retaining a supply of the product and a dispensing mechanism for dispensing a quantity of the supply of the product from the container, the dispensing mechanism including a draw tube with an inlet port disposed within the container, the security device comprising (a) one or more components adapted to transition between a first state and a second state, the one or more components restricting passage of the product through the draw tube when disposed in the first state and permitting passage of the product through the draw tube when disposed in the second state, and (b) an activation mixture for transitioning the one or more components from one of the first and second states to the other of the first and second states in response to an application of non-mechanical stimuli.

As another feature of the present invention, there is provided a system for dispensing a product, the system comprising (a) a container shaped to define an interior cavity, the container including at least one wall for separating the interior cavity into first and second compartments, the at least one wall being shaped to define an opening, and (b) a security device coupled to the at least one wall, the security device comprising a movable tab that selectively encloses the opening in the at least one wall.

Various other features and advantages will appear from the description to follow. In the description, reference is made to the accompanying drawings which form a part thereof, and in which is shown by way of illustration, various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE INVENTION

Product Dispensing System 11

Figure 1:
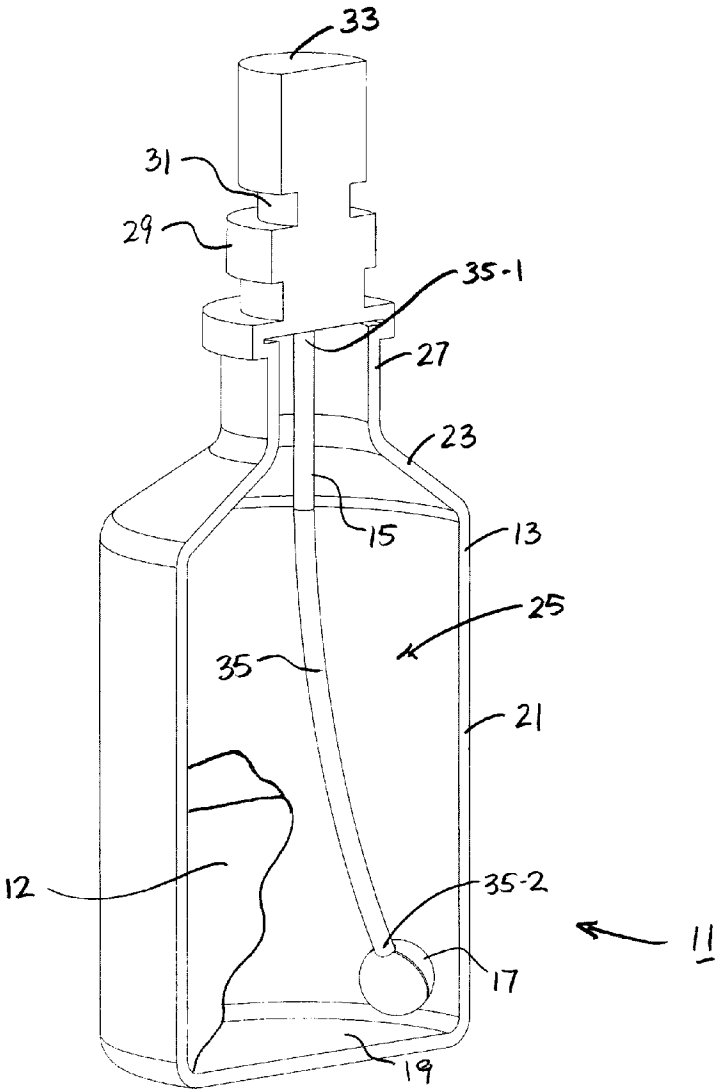
FIG. 1 is a front perspective, section view of an embodiment of a product dispensing system constructed according to the teachings of the present invention, the system being shown retaining a supply of product that is broken away in part.

Referring now to FIG. 1, there is shown a first embodiment of a system for dispensing a product, the product dispensing system being constructed according to the teachings of the present invention and identified generally by reference numeral 11. As will be described in detail below, system 11 is designed to prevent dispensing of a product 12 until properly purchased at the point-of-sale.

As defined herein, product 12 represents any substance that is commonly retained within a dispensable container. For example, product 12 may represent any liquid-based or semi-solid cosmetic mixture, such as, but not limited, to perfumes, lotions, soaps, creams, gels, moisturizers, shampoos and oils.

Product dispensing system, or dispenser, 11 comprises a container 13 for holding a supply of product 12, a pump-type dispensing mechanism 15 coupled to container 13 for enclosing container 13 and allowing a quantity of product 12 to be dispensed therefrom, and a remotely-activated security device 17 disposed within container 13 for selectively restricting the ability of mechanism 15 to dispense product 12 from container 13. In this capacity, it is to be understood that security device 17 can be used to prevent sampling of product 12 from container 13 until properly purchased, which is a principal object of the present invention.

Container 13 is represented herein as a generally rigid, cylindrical bottle, or receptacle, that includes an enclosed bottom wall 19, a continuous, rounded sidewall 21 and a top wall 23 that together define an enlarged interior cavity 25. An open neck 27, generally circular in transverse cross-section, extends upwardly from top wall 23 and serves as the sole means for accessing the contents retained within interior cavity 25. Although not shown herein, neck 27 may be externally threaded about its length to facilitate mounting of dispensing mechanism 15 thereon.

It should be noted that the particular design of container 13 does not serve as a principal feature of the present invention. Accordingly, it is to be understood that container 13 could be replaced with receptacles that have an alternative style and/or construction without departing from the spirit of the present invention.

As noted briefly above, dispensing mechanism 15 is coupled to container 13 and serves, inter alia, to enclose open neck 27 and permit a quantity of product 12 to be dispensed. For ease of illustration, dispensing mechanism 15 is represented herein in simplified form. As seen most clearly in FIG. 2, dispensing mechanism 15 preferably comprises an annular collar, or ferrule, 29 that is mounted over open neck 27 of container 13, a hollow stem 31 that is slidably displaceable within collar 29 and resiliently biased vertically upward relative thereto by a spring (not shown), an actuation head 33 mounted onto the uppermost end of hollow stem 31, and a dipping, or draw, tube 35 mounted on the lowermost end of stem 31 in fluid communication therewith.

Draw tube 35 is preferably constructed as elongated hollow member that is generally circular in transverse cross-section. As seen most clearly in FIG. 2, draw tube 35 is shaped to include a first open end 35-1 that is mounted onto stem 31 in fluid communication therewith, a second open end, or intake port, 35-2 disposed within the lower region of interior cavity 25 and a central, elongated passageway 35-3 extending longitudinally therethrough from first end 35-1 to second end 35-2. Draw tube 35 is preferably constructed of any durable material, such as one or more layers of a suitable polymer, glass or composite thereof, and is of a length sufficient to dispose intake port 35-2 in close proximity to bottom wall 19.

It should be noted that product dispensing system 11 is not limited to the pump-type dispensing mechanism 15 that is described in detail herein. Rather, it is to be understood that alternative types of dispensing mechanisms which utilize an internal draw tube (e.g., the dispensing mechanism utilized in a typical aerosol can) could be used in place of dispensing mechanism 15 without departing from the spirit of the present invention. For example, dispensing mechanisms of the type disclosed in either U.S. Pat. No. 3,990,611 to J. A. Sojka or U.S. Pat. No. 5,366,119 to J. B. Kline, both of the aforementioned disclosures being incorporated herein by reference, could be utilized in dispenser 11 in place of dispensing mechanism 15 without departing from the spirit of the present invention.

As will be described further in detail below, security device 17 is mounted onto draw tube 35 and is designed to selectively enclose intake port 35-2 and thereby preclude passage of product 12 therethrough. In this capacity, it is to be understood that security device 17 can be used to prevent sampling of product 12 from container 13 until properly purchased. The particular design and functionality of security device 17 provides product dispensing system 11 with a number of notable advantages and, as such, serves as a principal feature of the present invention.

Security Device 17

Figure 3:
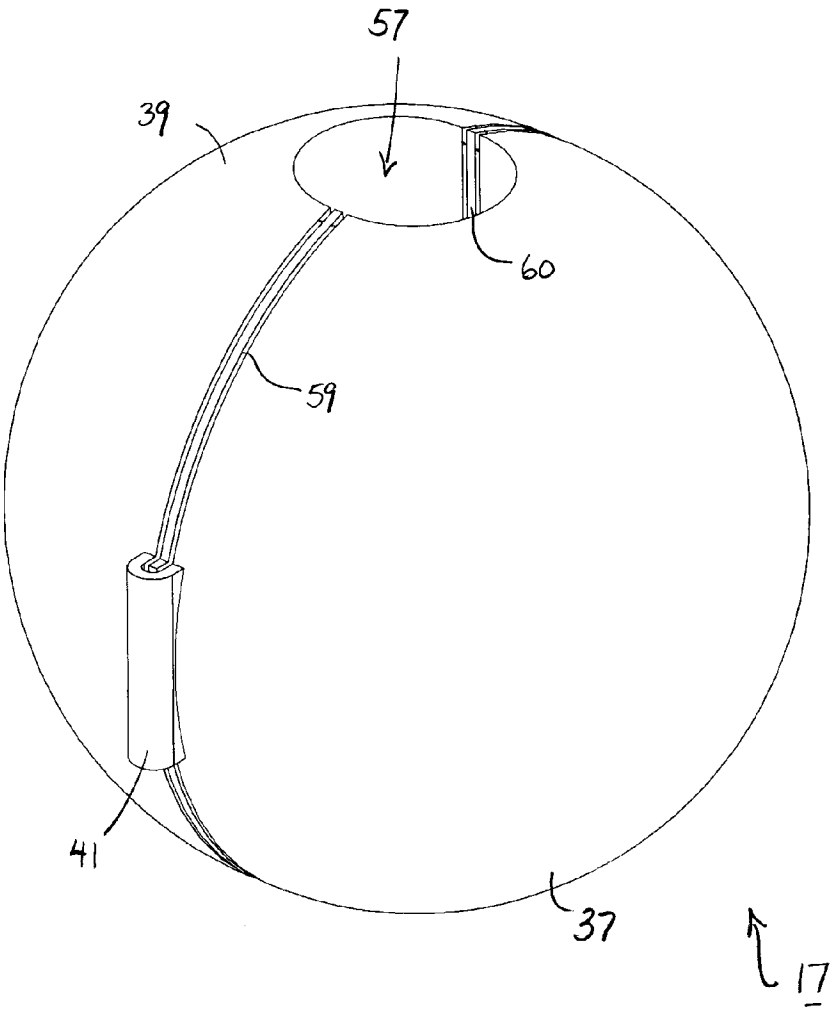
FIG. 3 is an enlarged, front perspective view of the security device shown in FIG. 1.
Figure 4:
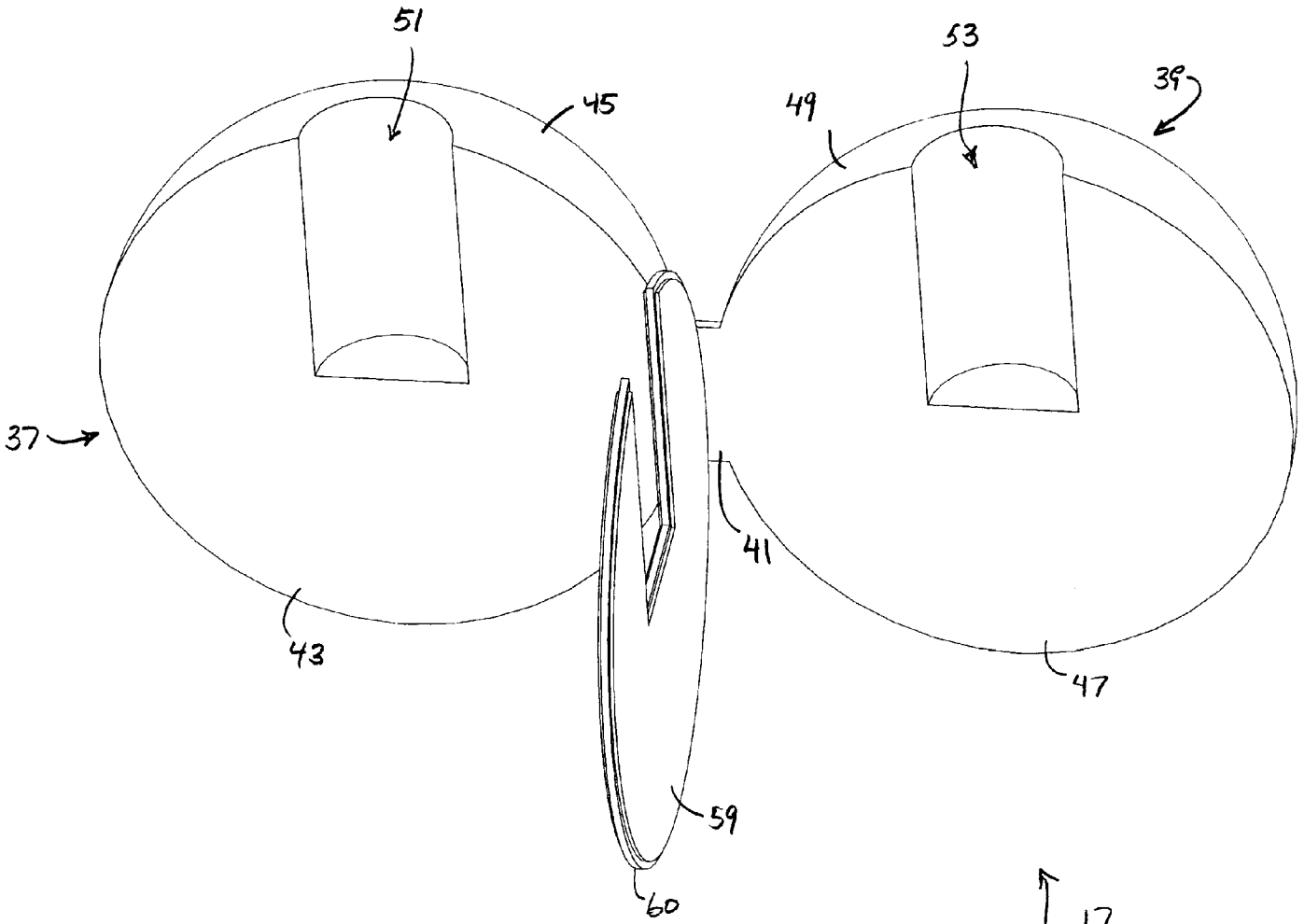
FIG. 4 is an enlarged, front perspective view of the security device shown in FIG. 1, the security device being shown with its first and second semispherical members pivoted open.

Referring now to FIGS. 1, 3 and 4, security device 17 is represented herein as an enclosable component that is mounted onto second end 35-2 of draw tube 35. As will be described further below, security device 17 is adapted to transition between a first, or barrier, state in which security device 17 encloses intake port 35-2 and thereby precludes drawing of product 12 therethrough and a second, or open, state in which security device 17 no longer fully encloses intake port 35-2 and thereby allows for the dispensing of product 12 from system 11. As a principal feature of the present invention, the means for modifying the state of security device 17 is achieved through the propagation, or remote-activation, of non-mechanical stimuli, as will be described further in detail below.

As defined herein, use of the term "non-mechanical stimuli" denotes any energy that can be used to remotely activate security device 17 without directly or indirectly physically manipulating or contacting system 11. Examples of non-mechanical stimuli include, but are not limited to, electrical energy, magnetic energy, electromagnetic energy, acoustical energy or thermal energy. For simplicity purposes only, radio frequency (RF) energy of a particular profile within the electromagnetic spectrum is described herein as the non-mechanical stimuli utilized to effect a change in the state of security device 17. However, it is to be understood that alternative types of non-mechanical stimuli could be used in place of RF energy without departing from the spirit of the present invention.

It is to be understood that the specified profile of the non-mechanical stimuli is preferably defined by one or more energy field characteristics. Examples of energy field characteristics include, but are not limited to, field type, field strength, frequency, power level and/or pulse spectrum.

Security device 17 is represented herein as a unitary, spherical, or pearl-like, enclosure that is preferably constructed of a rigid and durable material that is suitably coated to be rendered chemically inert to the contents retained within container 13. As can be seen, security device 17 is adapted to be mounted onto second end 35-2 of dipping tube 35. Accordingly, it is to be understood that security device 17 is located entirely within the interior of container 13. In this capacity, security device 17 does not aesthetically detract from the external appearance of system 11, which is a principal feature of the present invention.

As seen most clearly in FIGS. 3 and 4, security device 17 includes first and second generally semispherical members 37 and 39 that are connected along a common edge by a hinge 41, thereby providing security device 15 with a clam-like construction. As can be seen, first semispherical member 37 comprises a flattened inner surface 43 and a rounded outer surface 45. Similarly, second semispherical member 39 comprises a flattened inner surface 47 and a rounded outer surface 49. Due to its clam-like construction, security device 17 can be pivoted from its originally molded, open position in which flattened inner surfaces 43 and 47 are separated from one another and are disposed in a generally co-planar relationship, as shown in FIG. 4, to a closed position in which flattened inner surfaces 43 and 47 are drawn into direct, or near, contact with one another, as shown in FIG. 3.

An externally accessible cavity 51 is formed into flattened inner surface 43 of first semispherical member 37, cavity 51 being generally semicircular in transverse cross-section along the majority of its length. Similarly, an externally accessible cavity 53 is formed into flattened surface 47 of second semispherical member 39, cavity 53 being generally semicircular in transverse cross-section along the majority of its length. With security device 17 pivoted into its closed position, cavities 51 and 53 are aligned and configured to together define a tube receiving receptacle 57 that is generally circular in transverse cross-section, as seen in FIG. 3.

Figure 2:
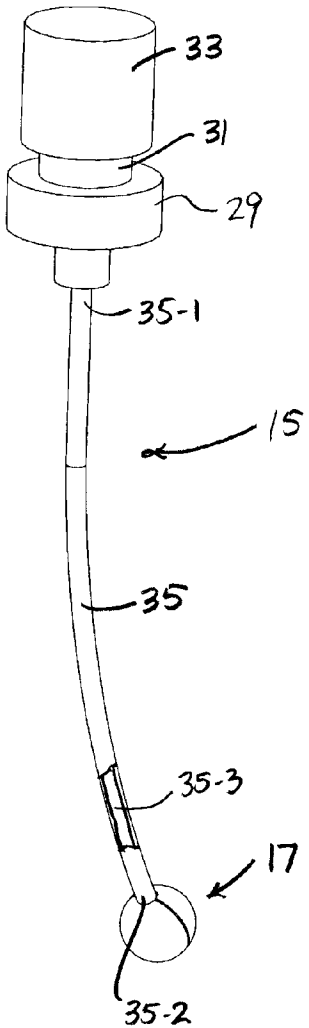
FIG. 2 is a front perspective view, broken away in part, of the dispensing mechanism and security device shown in FIG. 1.

Receptacle 57 is dimensioned to fittingly receive second end 35-2 of dipping tube 35 when security device 17 is disposed in its closed position, as shown in FIG. 2. It is to be understood that the frictional engagement between closed security device 17 and draw tube 35 is sufficient to adequately retain security device 17 mounted onto second end 35-2.

Security device 17 also preferably includes an activation mixture 59 that is applied to at least one of flat inner surfaces 43 and 47 (or, in the alternative, deposited within a recess formed in at least one of surfaces 43 and 47). In the present embodiment, activation mixture 59 is preferably in the form of a volume expanding, releasable adhesive that initially retains security device 15 closed with enough adhesive force that product 12 is unable to penetrate between members 37 and 39 and, in turn, enter draw tube 35 through inlet port 35-2. As will be described further in detail below, activation mixture 59 is designed to expand in volume in response to predefined non-mechanical stimuli to the extent necessary that members 37 and 39 at least partially separate and thereby enable product 12 to be drawn into dipping tube 35 through inlet port 35-2. As such, it is to be understood that activation mixture 59 can be utilized by a retail vendor to regulate the security state of device 17.

It should be noted that activation mixture 59 need not be limited to volume expanding adhesives but rather could be in the form of alternative materials that experience a change in one or more of its primary properties in response to the reception of non-mechanical stimuli. In fact, it is to be understood that a quantity of product 12 retained within container 13 could serve as the activation mixture in certain applications. For instance, a quantity of product 12 disposed between members 37 and 39 could be superheated in response to the application of non-mechanical stimuli to form a vapor or steam that, in turn, separates members 37 and 39.

As defined herein, use of the term "activation mixture" denotes any medium that is adapted to change in its chemical and/or physical properties in direct or indirect response to the emission of non-mechanical stimuli. For purposes of simplicity only, activation mixture 59 is described herein as being in the form of a material that is designed to significantly expand (approximately 10 to 40 times its original volume) in response to the emission of non-mechanical stimuli. However, it is to be understood that activation mixture 59 could rely upon alternative changes in its physical and/or chemical properties to effect a change in the state of security device 17 including, but not limited to, changes in its physical dimension, adhesion characteristics, tensile, compression or shear strength, surface energy, polarity, dielectric properties, viscoelastic properties, microstructure (e.g., degree of phase separation or amorphous or crystalline content), interfacial structure (e.g., degree of delamination, dewetting, or chain disentanglement), other forms of adhesive failure or change in cohesive strength, or combinations thereof.

Activation mixture may be in the form of an energy-releasable adhesive mixture of the type described in U.S. Patent Application Publication No. 2010/0300159 to J. S. Berg et al., the disclosure of which is incorporated herein by reference. The adhesive mixture described in the '159 application includes at least one polar polymer (e.g., polyethylene glycol), at least one non-polar polymer (e.g., hydroxyl terminated silicone polymer) and at least one electrically conductive material. In use, the adhesive mixture is adapted to transition from a first physiochemical state to a second physiochemical state in response to the emission of non-mechanical stimuli. As can be appreciated, the aforementioned change in the physiochemical state of the adhesive mixture can affect, among other things, its volumetric and/or adhesive characteristics.

Specific examples of thermally expanding particles or droplets that may be incorporated into activation mixture 59 include heat expandable microspheres that include a gaseous component, such as various hydrocarbons (e.g., methane, ethane, propane, n-butane, isobutene, n-pentane, isopentane, neopentane, n-hexane, isohexane, n-heptane, isoheptane, n-octane, isooctane, n-nonaone, isononane, n-decane, isodecane, and the like), cholorfluorcarbons, tetraalkylsilanes and/or combinations thereof. Additional examples of thermally expanding particles include thermally foamable microspheres or microcapsules that include a polymer outer shell (e.g., various copolymers of polymethacrylimide) that encapsulates a volatile foaming agent that is, for example, a low boiling point compound (e.g., hydrocarbon compounds) that can be vaporized at a temperature having a boiling point below or near the softening point of the encapsulated polymer so as to generate an expanding force. Further examples of thermally expanding particles include polymer-encapsulated particles (e.g., core/shell particles, polymers that are polymerized on the surfaces of water soluable monomer particles or aqueous dispersions of particles) particles that comprise liposome vesicles and the like (i.e., particles that hold a lipophobic substance, such as water and/or aqueous dispersions and the like).

Preferably, an energy conversion component 60 is disposed within activation mixture 59 (or in close proximity thereto) in order to convert the applied stimulus from one form of energy to a different form of energy. For instance, a metal layer or a plurality of metallic particles may be provided to receive the transmission of the applied non-mechanical stimulus and, in turn, convert the stimulus from its transmitted form of energy (e.g., electric or magnetic energy) into a second form of energy (e.g., heat), the second form of energy creating a concomitant change in at least one physical characteristic of the activation mixture 59.

Operation of Product Dispensing System 11

Referring now to FIGS. 1-4, dispenser 11 can be used in the following manner to provide security against the unauthorized dispensing of product 12 retained therein. Specifically, system 11 is assembled with security device 17 mounted onto second end 35-2 of draw tube 35. As referenced briefly above, the tight enclosure of security device 17 around second end 35-2 creates a firm seal, or barrier, against drawing product 12 into draw tube 35. By precluding product 12 from being drawn into dipping tube 35, security device 17 effectively prevents all unauthorized dispensing of product 12 from dispenser 11 without detracting from the overall aesthetics of its external appearance, which is a principal object of the present invention.

Once purchase is validated at the point-of-sale, the vendor applies predefined non-mechanical stimuli to system 11 (e.g., by disposing container 13 on, or in proximity to, an activation/deactivation pad designed to transmit RF signals of particular profile). The application of the non-mechanical stimuli results in the expansion of activation mixture 59 which, in turn, at least partially separates semispherical members 37 and 39. As can be appreciated, members 37 and 39 separate to the extent necessary that product 12 is can be drawn into dipping tube 35 through inlet port 35-2. In other words, the application of non-mechanical stimuli causes security device 17 to transition from a first state in which security device 17 seals intake port 35-2 to a second state in which security device 17 fails to effectively seal intake port 35-2.

Although not shown herein, it is to be understood that the partial separation of semispherical members 37 and 39 may loosen the fitted relation and frictional engagement between security device 17 and draw tube 35 to the extent necessary that spherical security device 17 slides off draw tube 35 and either floats on or submerges within product 12.

Additional Embodiments and Design Modifications

The embodiment shown above is intended to be merely exemplary and those skilled in the art shall be able to make numerous variations and modifications to it without departing from the spirit of the present invention. All such variations and modifications are intended to be within the scope of the present invention as defined in the appended claims.

For example, although security device 17 is represented herein as having a generally spherical design, it is to be understood that security device 17 could be constructed in alternative geometries (e.g., rectangular, triangular, square, conical, spiral and the like) without departing from the spirit of the present invention. Essentially, security device 17 could be constructed in any design as long as its configuration allows for the suitable enclosure of second end 35-2 of draw tube 35 when disposed its barrier state.

As another example, it should be noted that security device 17 need not rely upon a clam-like, or hinged, construction in order to selectively enclose second end 35-2 of draw tube 35. Rather, it is to be understood that alternative means for selectively enclosing second end 35-2 of draw tube 35 could be implemented without departing from the spirit of the present invention.

Figure 5A:
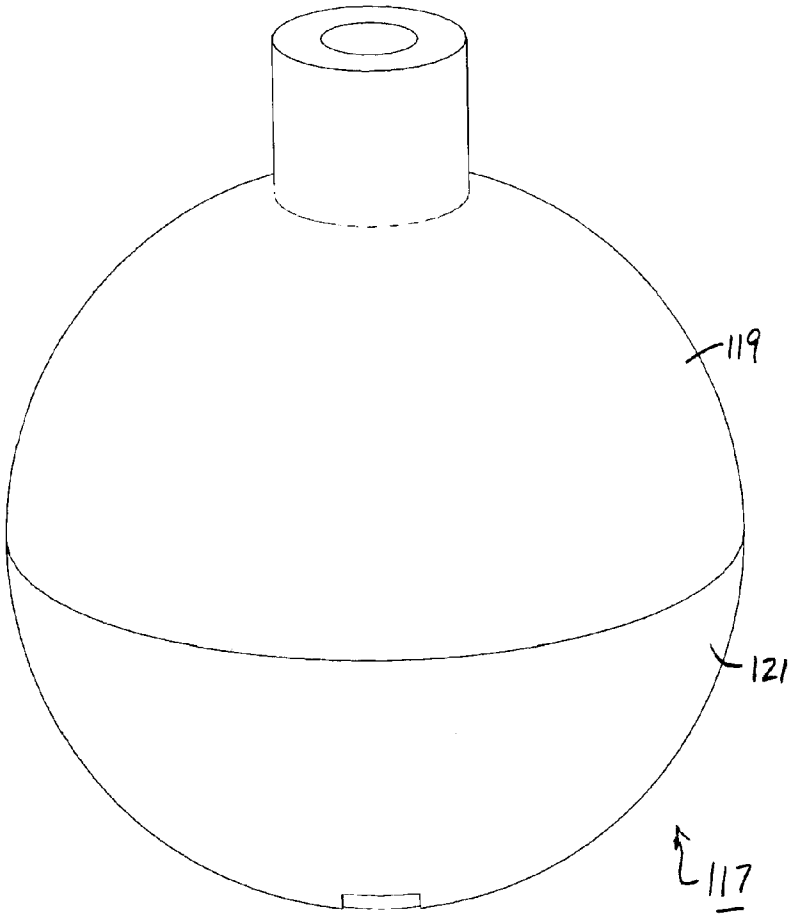
FIGS. 5(*a*) and 5(*b*) are enlarged, front perspective views of a modification of the security device shown in FIG. 3, the modified security device being shown in its closed and open states, respectively.
Figure 5B:
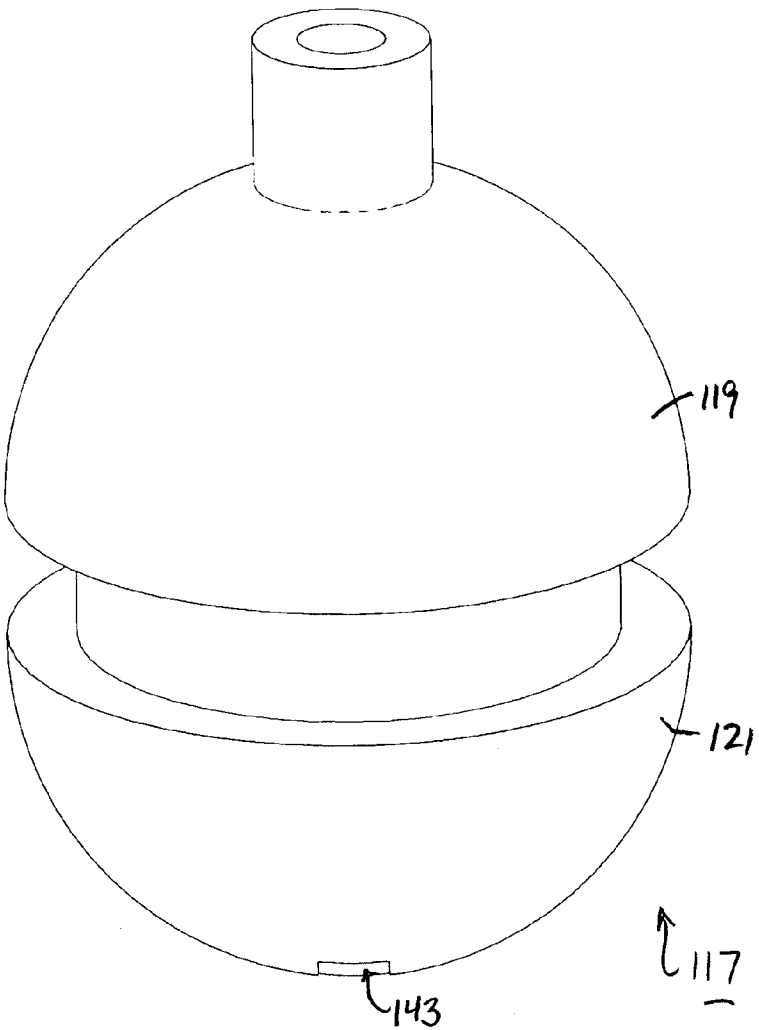

Specifically, referring now to FIGS. 5(*a*) and 5(*b*), there is shown a modified version of a security device for a product dispensing system, the security device being constructed according to the teachings of the present invention and identified generally by reference numeral 117. As will be described further below, security device 117 is similar to security device 17 in that security device 117 is adapted to be mounted directly onto draw tube 35 and selectively regulate product intake through intake port 35-2 using remote activation means. However, security device 117 differs from security device 17 in that security device 117 relies upon a pair of slidably coupled semispherical members, rather than a pair of hingedly coupled semispherical members, to achieve selective regulation of product intake through dipping tube 35.

Security device 117 comprises upper and lower generally semispherical members 119 and 121 that are slidably joined together. In this manner, security device 117 is adapted for slidable displacement between a compact, or closed, state (as shown in FIG. 5(*a*)) and an expanded, or open, state (as shown in FIG. 5(*b*)).

Figure 6A:
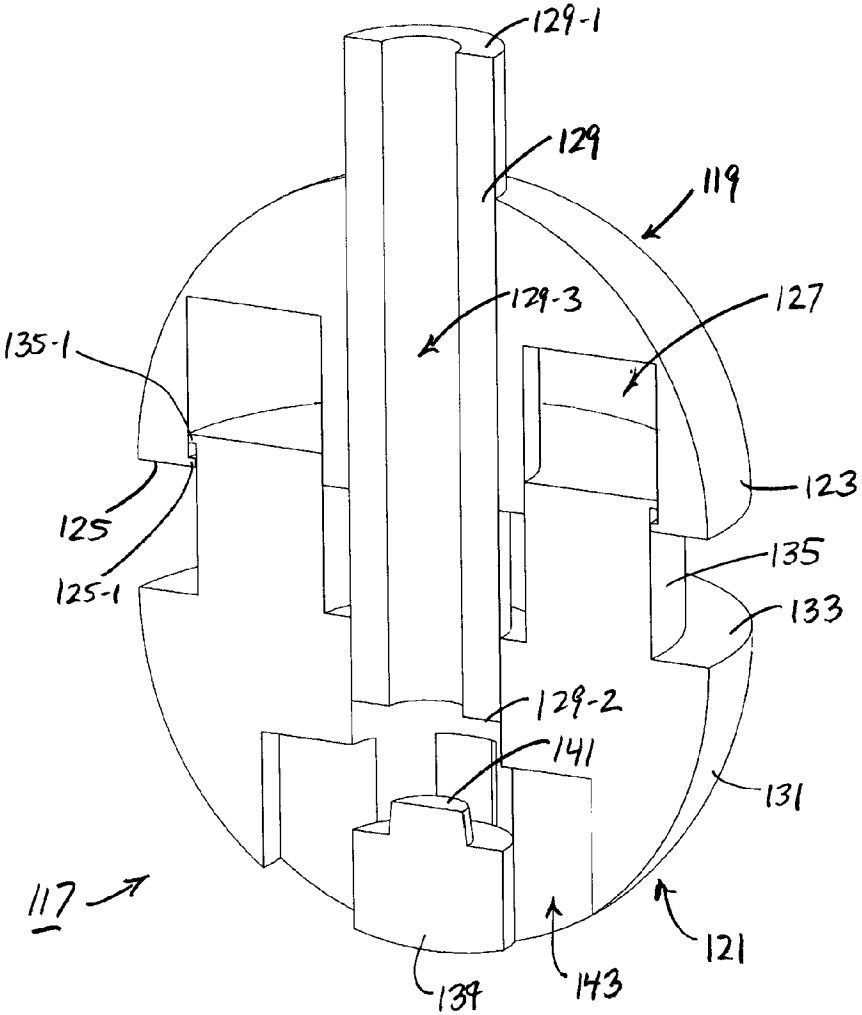
FIGS. 6(*a*) and 6(*b*) are section perspective and section plan views, respectively, of the modified security device shown in FIG. 5(*b*) taken along lines 6-6, the security device being shown without its activation mixture in FIG. 6(*a*) for purposes of clarity.
Figure 6B:
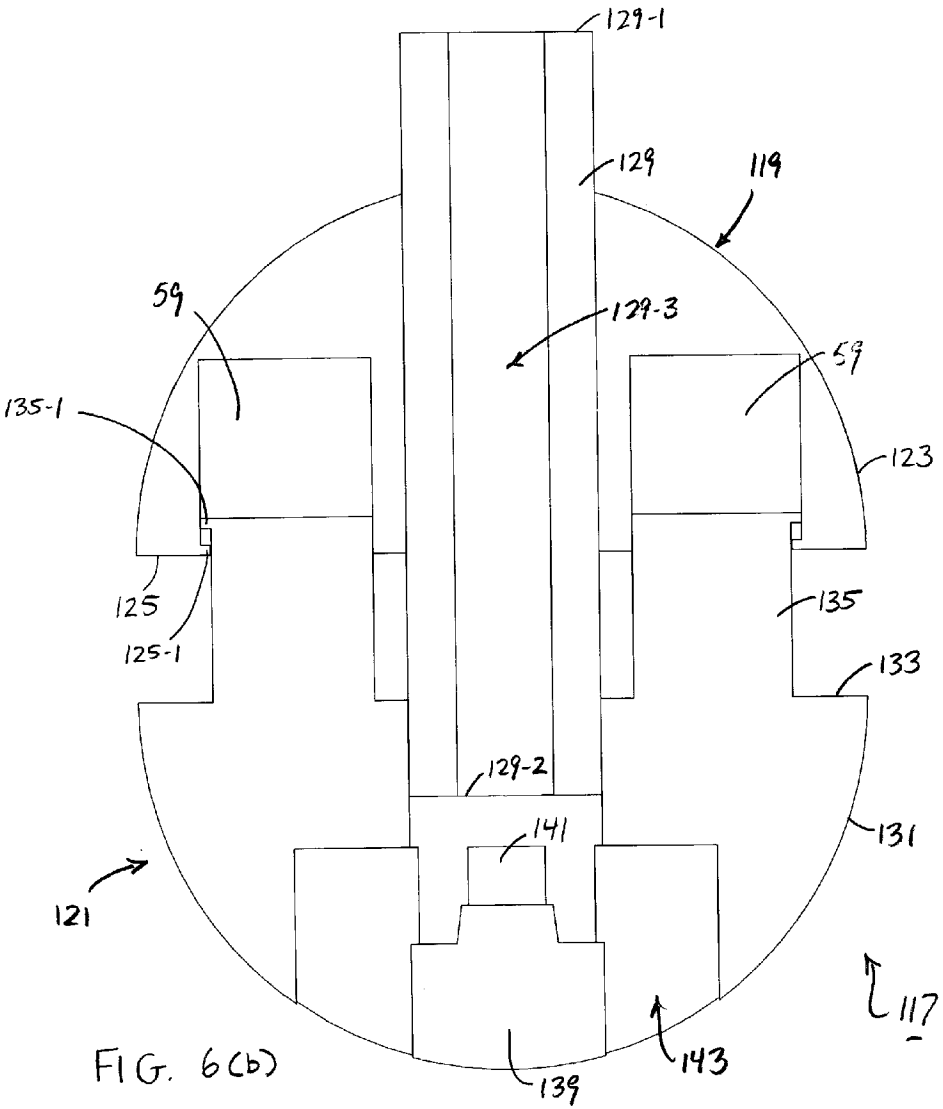

As seen most clearly in FIGS. 6(*a*) and 6(*b*), upper semispherical member 119 includes a rounded outer surface 123 and a generally flat inner surface 125. An annular recess 127, generally rectangular in transverse cross-section is formed into flat inner surface 125, the function of recess 127 to become apparent below.

In addition, upper semispherical member 119 includes a generally cylindrical sleeve 129 that extends longitudinally through its apex. Sleeve 129 is hollowed out along the entirety of its length and includes a first end 129-1 that projects slightly upward from outer surface 123, a second end 129-2 that projects downward from bottom surface 125, and an elongated channel 129-3 extending longitudinally therethrough from first end 129-1 to second end 129-2.

Preferably, first end 129-1 is dimensioned to receive intake port 35-2 of draw tube 35 in a fitted telescoping relationship relative thereto, thereby rendering channel 129-3 in direct fluid communication with passageway 35-3. It is to be understood that the frictional engagement between sleeve 129 and second end 35-2 permanently retains security device 117 mounted on draw tube 35.

Lower semispherical member 121 includes a rounded outer surface 131 and a generally flat inner surface 133. As seen most clearly in FIGS. 6(*a*) and 6(*b*), an annular protrusion 135 projects out from inner surface 133 and is sized and shaped to fittingly extend into recess 127 in upper semispherical member 121. Protrusion 135 is dimensioned such that a narrow gap is defined between upper and lower semispherical members 121 and 123 when security device 117 is disposed in its closed state, the function of the gap to become apparent below.

It should be noted that the distal end of protrusion 135 is provided with an outwardly protruding flange 135-1. Similarly, the portion of flat inner surface 125 that immediately defines recess 127 is provided an inwardly protruding flange 125-1. As can be appreciated, flanges 125-1 and 135-1 function as complementary interlocking elements that prevent complete disassociation of members 119 and 121.

A plug 139 is integrally formed into rounded outer surface 131 of lower semispherical member 121 and includes an upwardly extending, generally cylindrical projection 141. As will be described further below, projection 141 is dimensioned to at least partially protrude into channel 129-3 through second end 129-2 in a fitted relationship, thereby creating a seal that prohibits product 12 from entering sleeve 129.

A plurality of cavities 143 are formed into rounded outer surface 131 around the periphery of plug 139, as seen most clearly in FIG. 6(*a*). With security device 117 disposed in its expanded state, cavities 143 extend in fluid communication with second end 129-2 and thereby serve as pathways through which product 12 can enter sleeve 129 and, in turn, be drawn into dipping tube 35.

As seen most clearly in FIG. 6(*b*), a supply of activation mixture 59 is provided in the gap defined between members 119 and 121. In the present embodiment, activation mixture 59 is represented as an adhesive that is designed to significantly expand in volume in response to predefined non-mechanical stimuli and thereby transform security device 117 from its closed state to its open state.

In use, activation mixture 59 can be remotely actuated by a vendor in a retail environment to regulate the security state of device 117. Specifically, with security device 117 mounted on second end 35-2 of draw tube 35 and disposed in its closed state, projection 141 on plug 139 at least partially protrudes channel 129-3 through second end 129-2 in a fitted relationship relative thereto. As a result, security device 117 serves as a barrier, or seal, that prevents product 12 from being drawn into dipping tube 35. By precluding product 12 from being drawn into dipping tube 35, security device 117 effectively prevents all unauthorized dispensing of product 12 from the dispenser without detracting from the aesthetics of its external appearance.

Once purchase is validated at the point-of-sale, the vendor applies predefined non-mechanical stimuli to activation mixture 59 which, in turn, results in its expansion. As noted above, the expansion of mixture 59 results in the separation of upper and lower semispherical members 119 and 121 and, in particular, the separation of plug 139 from sleeve 129. With security device 117 disposed in its open state, product 12 can be drawn into sleeve 129, and ultimately into dipping tube 35, through cavities 143. Having effectively deactivated security device 117, product 12 is able to be freely dispensed by the user, as needed.

As previously referenced, activation mixture 59 need not be limited to volume expanding adhesives but rather could be in the form of alternative materials that experience a change in one or more of its primary properties in response to the reception of non-mechanical stimuli. In fact, it is to be understood that a quantity of product 12 retained within container 13 could serve as the activation mixture in certain applications. For instance, a quantity of product 12 could be injected into the gap defined between members 119 and 121 and, in turn, superheated in response to the application of non-mechanical stimuli to form a vapor or steam that, in turn, separates members 119 and 121.

Although each of security devices 17 and 117 is represented above as an independently manufactured, separable component that is mounted onto draw tube 35 during one step of its assembly process, it is to be understood that means for remotely controlling the ability to draw product 12 into draw tube 35 could be directly integrated into either container 13 or dispensing mechanism 15 without departing from the spirit of the present invention.

Figure 7B:
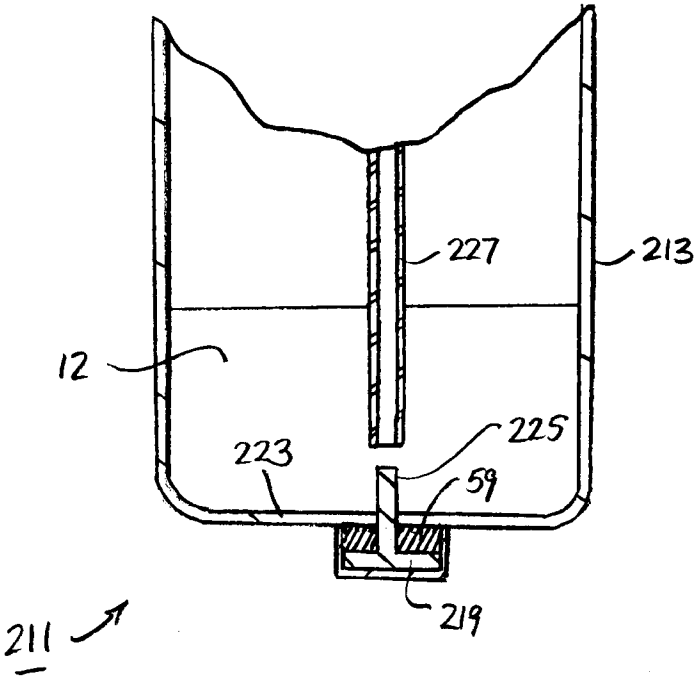
FIGS. 7(*a*) and 7(*b*) are fragmentary section views of another embodiment of a product dispensing system constructed according to the teachings of the present invention, the system being shown retaining a supply of product, the system being shown in its closed and open states, respectively.
Figure 7A:
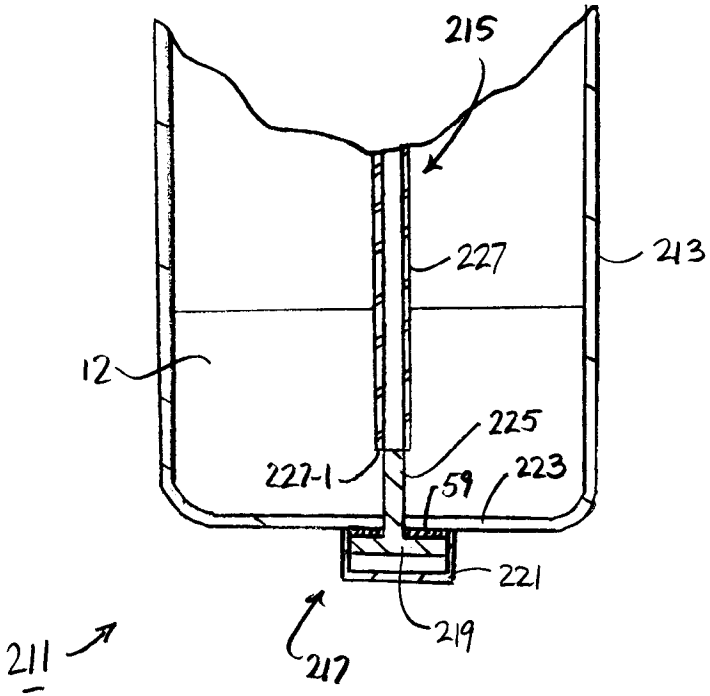

For instance, referring now to FIGS. 7(*a*) and 7(*b*), there are shown simplified section views of another embodiment of a product dispensing system constructed according to the teachings of the present invention, the product dispensing system being identified generally by reference numeral 211. As seen most clearly in FIG. 7(*a*), system 211 is similar to system 11 in that system 211 includes a container 213 for holding a supply of product 12, a pump-type dispensing mechanism 215 coupled to container 213 for enclosing container 213 and allowing a quantity of product 12 to be dispensed therefrom, and a remotely-activated security device 217 for selectively restricting the ability of mechanism 215 to dispense product 12 from container 213.

System 211 differs from system 11 in that security device 217 is integrated into, or otherwise coupled to, container 213 and is not constructed as a separable component. Specifically, security device 217 is represented herein as comprising a base 219 that is disposed within a cap-like bracket, or enclosure, 221. In turn, bracket 221 is secured to the exterior of a bottom wall 223 formed in container 213. Although not shown herein, it is to be understood that bracket 221 could be disguised or otherwise hidden within container 213 (e.g., by disposing bracket 221 within an interior pocket formed within bottom wall 223).

A stem, or post, 225 is formed onto base 219 and projects orthogonally out therefrom. As can be seen, stem 225 extends into container 213 through a sealed opening in bottom wall 223 in coaxial alignment with a draw tube 227 for dispensing mechanism 215. Stem 225 is preferably dimensioned such that its distal end contacts, or otherwise encloses, intake port 227-1 of draw tube 227. In this manner, stem 225 serves to prevent unauthorized dispensing of product 12 from dispenser 211 without significantly detracting from the aesthetics of its external appearance.

A supply of activation mixture 59 is disposed between base 219 and bottom wall 223. As noted above, activation mixture 59 is preferably designed to significantly expand in volume in response to predefined non-mechanical stimuli. As seen most clearly in FIG. 7(*b*), the expansion of activation mixture 59 displaces base 219 away from bottom wall 223 until stem 225 separates from draw tube 227 and thereby enables product 12 to be drawn in through the open end of draw tube 227. In this manner, it is to be understood that activation mixture 59 can be remotely actuated by a vendor in a retail environment to regulate the security state of device 217.

All of the systems described in detail above prevent unauthorized dispensing of product 12 by limiting (i.e., selectively sealing) the passage of product 12 through the intake port of draw tube. However, it is to be understood that alternative means for regulating the dispensing of product could be provided without departing from the spirit of the present invention.

As an example, a modified security device could be releasably secured to the container or dispensing mechanism of a pump-type dispenser in order to restrict the movement of selected components of its dispensing mechanism (e.g., the movable stem on which the actuation head is mounted). A movement restricting security device of the type described above could be adhesively secured in place within the dispenser using activation mixture 59. Accordingly, it is to be understood that through the remote actuation of mixture 59, the security device could be transformed from a first state in which the security device limits movement of selected mechanical components of the dispenser to a second position in which the security device freely permits movement of the previously restricted mechanical components.

As another example, a modified security device could be releasably secured to the container and function as a remotely-activated valve for selectively enclosing the open neck, or outlet port, through which product exits the container. Specifically, referring now to FIGS. 8(*a*) and 8(*b*), there are shown simplified section views of another embodiment of a product dispensing system constructed according to the teachings of the present invention, the product dispensing system being identified generally by reference numeral 311.

Figure 8B:
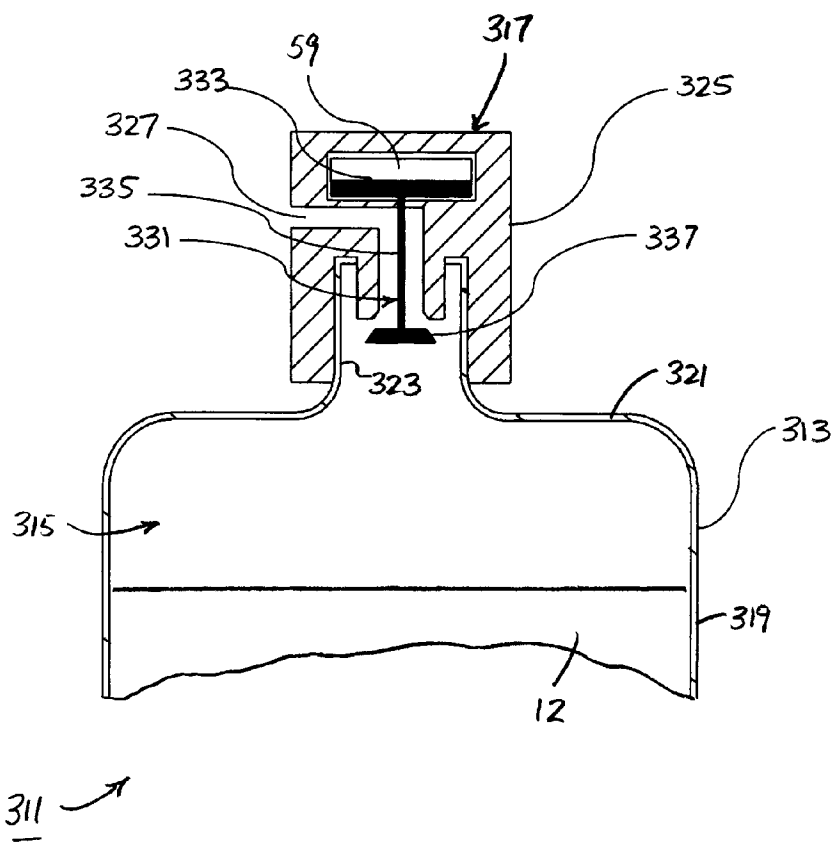
FIGS. 8(*a*) and 8(*b*) are fragmentary section views of another embodiment of a product dispensing system constructed according to the teachings of the present invention, the system being shown retaining a supply of product, the system being shown in its closed and open states, respectively.
Figure 8A:
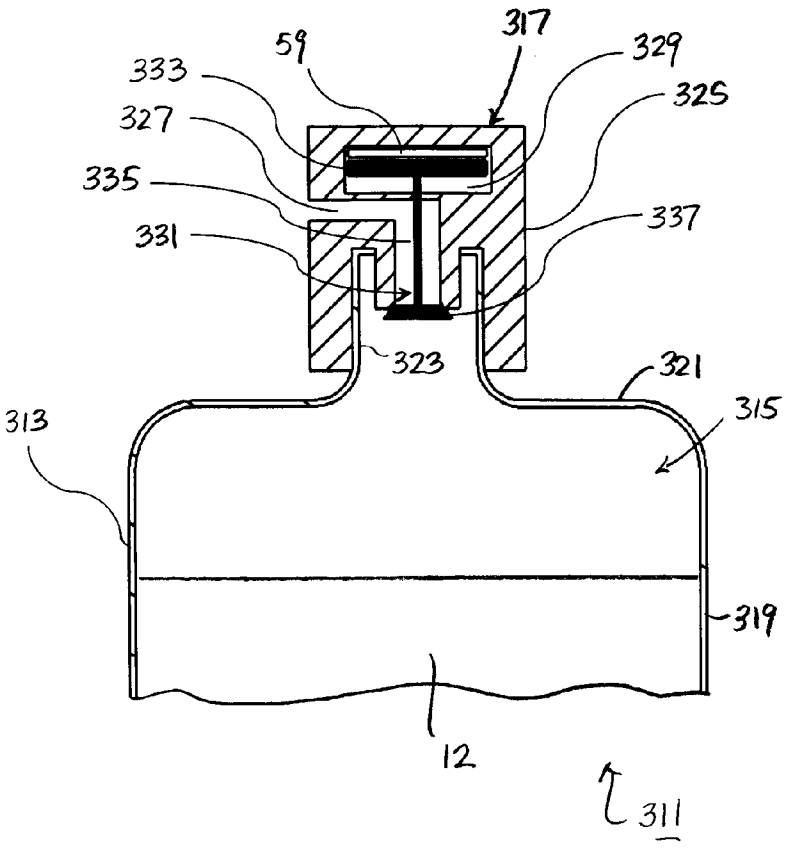

As seen most clearly in FIG. 8(*a*), system 311 is similar to system 11 in that system 311 includes a container 313 shaped to define an interior cavity 315 for retaining a supply of product 12 and a remotely-activated security device 317 for regulating the dispensing of product 12 from container 313.

In the present embodiment, container 313 is represented as a squeeze-type bottle that includes an enclosed bottom wall (not shown), a continuous, rounded sidewall 319 and a top wall 321 that together define enlarged interior cavity 315. An open neck 323, generally circular in transverse cross-section, extends upwardly from top wall 321 and serves as the sole orifice, or exit port, for dispensing the contents retained within interior cavity 315.

Due to the squeeze-type construction of container 313, system 311 does not require a pump-type dispensing mechanism. Rather, product 12 is dispensed from container 313 through the application of pressure onto its compressible sidewall 319.

Security device 317 is coupled to open neck 323 of container 313 and is adapted to selectively restrict the passage of product 12 therethrough. As represented herein, security device 317 includes a cap 325 that is mounted over open neck 323. Cap 325 serves to enclose open neck 323 and is shaped to include both an exit hole 327 in communication with interior cavity 315 and an enclosed internal cavity 329.

A movable piston 331 is slidably disposed within cap 325 and is adapted to selectively seal open neck 323. Piston 331 includes a base 333 that is slidably disposed within cavity 329 in cap 325, a stem 335 integrally formed onto base 333 that protrudes through cap 325 and into open neck 323, and a stop 337 formed onto the free end of stem 335 that is initially disposed and configured, in combination with cap 325, to seal open neck 323 and thereby preclude the dispensing of product 12 therethrough.

A supply of activation mixture 59 is disposed between the top surface of base 333 and cap 325. As noted above, activation mixture 59 is preferably designed to significantly expand in volume in response to predefined non-mechanical stimuli. As seen most clearly in FIG. 8(*b*), the expansion of activation mixture 59 displaces base 333 away from cap 325 so that stop 337 moves into interior cavity 315 to the extent necessary that product 12 can exit container 313 through hole 327. In this manner, it is to be understood that activation mixture 59 can be remotely actuated by a vendor in a retail environment to regulate the security state of device 317.

As another example, a product dispensing system could be provided with a remotely-activated security device that functions as a movable partition for temporarily separating ingredients of the product to be dispensed. Specifically, referring now to FIGS. 9(*a*) and 9(*b*), there are shown simplified section views of another embodiment of a product dispensing system constructed according to the teachings of the present invention, the product dispensing system being identified generally by reference numeral 411.

As can be seen, system 411 is similar to system 11 in that system 411 includes a container 413 shaped to define an interior cavity 414 for holding a supply of product 12, a pump-type dispensing mechanism 415 coupled to container 413 for enclosing container 413 and allowing a quantity of product 12 to be dispensed therefrom, and a remotely-activated security device 417.

System 411 differs from system 11 in that container 413 includes at least one interior wall 419 that is shaped to define a central opening 421. In the present embodiment, interior wall 419 is horizontally disposed and separates interior cavity 414 into an upper compartment 423 and a lower compartment 425 that are in fluid communication with one another through opening 421 in wall 419.

Figure 9B:
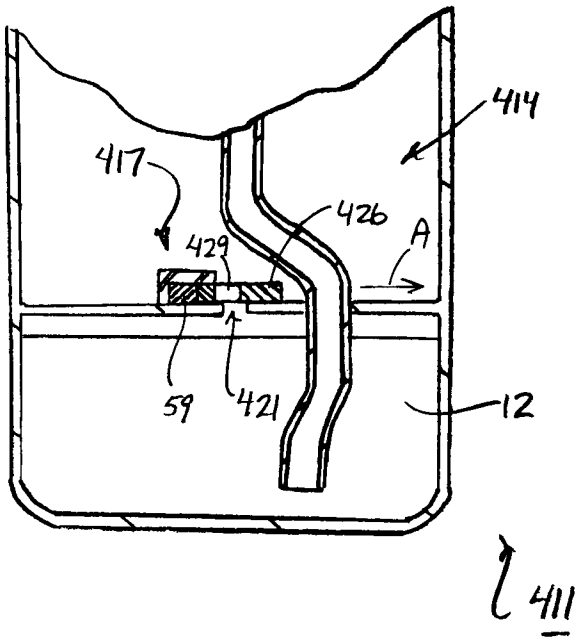
FIGS. 9(*a*) and 9(*b*) are fragmentary section views of another embodiment of a product dispensing system constructed according to the teachings of the present invention, the system being shown retaining two separate elements of a product, the system being shown in its closed and open states, respectively.
Figure 9A:
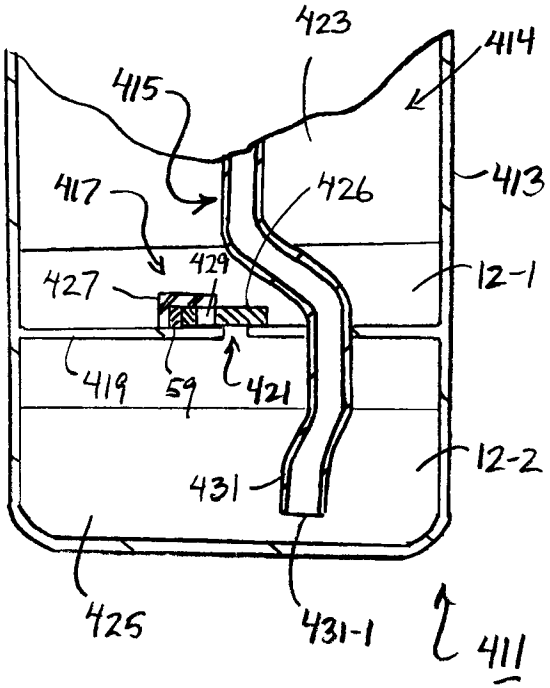

Security device 417 is coupled to horizontal interior wall 419 and includes an enlarged tab 426 that is disposed within a cap-like bracket, or enclosure, 427 mounted onto interior wall 419. Although tab 426 is shaped to include a transverse hole 429, it is to be understood that tab 426 is dimensioned and originally disposed so that hole 429 does not align with opening 421. As a result, tab 426 initially serves to enclose central opening 421 in wall 419 and thereby render upper and lower compartments 423 and 425 not in fluid communication with one another, as shown in FIG. 9(*a*).

Accordingly, it is to be understood that first and second contents 12-1 and 12-2 of product 12 could be separately retained within compartments 423 and 425, respectively. For instance, security device 417 may be used to separate an active ingredient, such as a fragrance, which is more expensive in nature, from the remainder of product 12, such as an alcohol-based solvent. Without suitable mixture of elements 12-1 and 12-2, a draw tube 431 for dispensing mechanism 415 that extends transversely through interior wall 419 in a sealed manner is only able to draw one compositional element of product 12 through its intake port 431-1. The inferior quality of the unmixed dispensed product would, in turn, serve as a deterrent effect for unauthorized sampling.

A supply of activation mixture 59 is disposed between one end of tab 426 and bracket 427. As noted above, activation mixture 59 is preferably designed to significantly expand in volume in response to predefined non-mechanical stimuli. The expansion of activation mixture 59 horizontally displaces tab 426 (in the direction represented generally by arrow A in FIG. 9(*b*)) to the extent necessary that hole 429 aligns with opening 421. As a result, contents 12-1 and 12-2 are able to mix within interior cavity 414. In this manner, it is to be understood that activation mixture 59 can be remotely actuated by a vendor in a retail environment to mix, or otherwise prepare, product 12 for subsequent dispensing.

What is claimed is:

1. A system for dispensing a product, the system comprising:

(a) a container shaped to define an interior cavity, the container being adapted to retain a supply of the product within the interior cavity;

(b) a dispensing mechanism adapted to dispense a quantity of the supply of the product from the container, the dispensing mechanism including a draw tube with an intake port disposed within the interior cavity; and (c) a security device coupled to the draw tube, the security device including an activation mixture for transitioning the security device from a first state to a second state in response to an application of non-mechanical stimuli, the security device restricting the passage of the product through the draw tube when disposed in the first state and permitting the passage of the product through the draw tube when disposed in the second state.

2. The system as claimed in claim 1 wherein the security device is mounted onto and selectively encloses the intake port of the draw tube.

3. The system as claimed in claim 2 wherein the security device is located entirely within the interior cavity of the container.

4. The system as claimed in claim 1 wherein the security device is adapted to transition between the first and second states in response to the application of non-mechanical stimuli selected from the group consisting of electrical energy, magnetic energy, electromagnetic energy, acoustical energy and thermal energy.

5. The system as claimed in claim 1 wherein the security device is adapted to transition between the first and second states in response to the application of non-mechanical stimuli of a particular profile.

6. The system as claimed in claim 5 wherein the particular profile of the non-mechanical stimuli is defined using an energy field characteristic selected from the group consisting of field type, field strength, frequency, power level and pulse spectrum.

7. The system as claimed in claim 1 wherein at least one of the chemical and physical properties of the activation mixture changes in response to the application of non-mechanical stimuli.

8. The system as claimed in claim 7 wherein at least one of the volumetric and adhesive characteristics of the activation mixture changes in response to the application of non-mechanical stimuli.

9. The system as claimed in claim 7 wherein the security device comprises:

(a) a first member; and (b) a second member hingedly coupled to the first member, the first and second members together defining a receptacle for receiving the intake port of the draw tube;

(c) wherein the first and second members are adapted to pivot between a closed position in which the intake port is closed by at least one of the first and second members and an open position in which the intake port is at least partially open.

10. The system as claimed in claim 9 wherein the activation mixture is at least partially disposed between the first and second members.

11. The system as claimed in claim 10 wherein the activation mixture disposes the first and second members into the open position from the closed position in response to the application of non-mechanical stimuli.

12. A security device for a product dispensing system, the product dispensing system comprising a container for retaining a supply of the product and a dispensing mechanism for dispensing a quantity of the supply of the product from the container, the dispensing mechanism including a draw tube with an inlet port disposed within the container, the security device comprising:

(a) one or more components adapted to transition between a first state and a second state, the one or more components restricting passage of the product through the draw tube when disposed in the first state and permitting passage of the product through the draw tube when disposed in the second state; and (b) an activation mixture for transitioning the one or more components from the first state to the second state in response to an application of non-mechanical stimuli.

13. The security device as claimed in claim 12 wherein at least one of the chemical and physical properties of the activation mixture changes in response to the application of non-mechanical stimuli.

* * * * *